US006078316A

United States Patent [19]

Page et al.

[11] Patent Number: 6,078,316

[45] **Date of Patent: *Jun. 20, 2000**

[54] DISPLAY MEMORY CACHE

[75] Inventors: Rich Page, Los Altos Hills; James Wiseman, Palo Alto; Jon Gibbons, San Francisco, all of Calif.

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/434,285

[22] Filed: May 3, 1995

Related U.S. Application Data

[63] Continuation of application No. 07/851,567, Mar. 16, 1992.

[51] Int. Cl.[7] ..... G09G 3/18

[52] U.S. Cl. ..... 345/204; 345/87; 345/507

[58] Field of Search ..... 345/100, 98, 97, 345/200, 197, 87, 88, 89–93, 204, 340, 3, 507, 516–518; 348/415

[56] References Cited

U.S. PATENT DOCUMENTS

| | | | |
|---|---|---|---|
| 4,149,151 | 4/1979 | Nagae et al. | 340/765 |
| 4,393,379 | 7/1983 | Berting et al. | 345/100 |
| 4,655,561 | 4/1987 | Kanbe et al. | 350/350 |
| 4,691,200 | 9/1987 | Stephany | 340/784 |
| 4,694,288 | 9/1987 | Harada | 345/340 |
| 4,695,838 | 9/1987 | Ellis, Jr. | 345/204 |
| 4,922,241 | 5/1990 | Inoue et al. | 345/98 |
| 4,951,232 | 8/1990 | Hannah | 364/522 |
| 4,952,032 | 8/1990 | Inoue et al. | 345/101 |
| 4,987,551 | 1/1991 | Garrett, Jr. | 364/521 |
| 5,172,107 | 12/1992 | Kanno et al. | 340/784 |
| 5,218,274 | 6/1993 | Zenda | 345/3 |
| 5,264,839 | 11/1993 | Kanno et al. | 345/185 |
| 5,345,250 | 9/1994 | Inoue et al. | 345/98 |
| 5,436,636 | 7/1995 | Nonoshita et al. | 345/98 |
| 5,799,202 | 8/1998 | Rangione | 345/516 |

*Primary Examiner*—Lun-Yi Lao
*Attorney, Agent, or Firm*—Fitzpatrick, Cella, Harper & Scinto

[57] ABSTRACT

An optimized refresh strategy for increasing bandwidth of an LCD. The present invention results in an LCD suitable for dynamic display of information. In the present invention, a display memory is used to store display data generated by a CPU and to provide that data to an LCD. All data writes to the display memory by the CPU are tracked and rows or columns that contain modified data are tagged. These tags may be "set" by mapping the display memory write addresses to row or column numbers. The tags are examined and mapped back into the display memory addresses and only those rows or columns containing changed data are transferred to the data stream for display. As a result, only the information that is changed in the display memory is sent to the display and the dynamic bandwidth of the display is maximized. The refresh in the present invention can be either row-based or column-based.

27 Claims, 7 Drawing Sheets

DISPLAY MEMORY CACHE

This application is a continuation of application Ser. No. 07/851,567 filed Mar. 16, 1992, now abandoned.

BACKGROUND OF THE INVENTION

1. Field of the Invention

This invention relates to the field of computer display memories and, in particular, a display random access memory for use with a liquid crystal display (LCD) device.

2. Background Art

In a computer system, a display device is provided to view data entered by a user and to view the results of processing operations on that data. Often, a liquid crystal display (LCD) is utilized as the display device. The LCD has the advantage of being flat as compared to the substantial depth of a cathode ray tube (CRT) type display. Therefore, LCD's have particular application in situations where size is a factor, such as in portable or lap-top computers, hand-held televisions, watches, etc.

An LCD consists of an array of "cell" or "pixel" (picture element) locations. In a monochromatic display, each pixel location has two states, "on" or "off." In one state, the pixel is black, and in the other state the pixel is white. By selectively setting the state of certain pixels, the array of pixels, when viewed in combination, forms an image.

Each pixel or cell of the LCD consists of liquid crystal material disposed between two cell plates, a front plate and a rear plate. The liquid crystal material may be one of many well-known compositions, such as the ferro-electric liquid crystal known as DOBAMBC. The front plate (which is transparent) and the rear plate each support an electrode so that an electric field can be applied to the liquid crystal material in the cell. The liquid crystal material can be switched between two stable conditions by applying an appropriate electric field. Typically, a varying voltage is applied to each of the plates in order to switch the states of the liquid crystal material. Cancellation techniques are used to alleviate cross talk problems. By switching the states of the liquid crystal material, the cell can be made transparent (white) or opaque (black). Thus, the liquid crystal material can be used to generate a monochromatic display.

The voltage required to switch the state of a ferro-electric LCD cell is referred to as its "threshold" voltage $V_T$. To switch the state of an LCD cell, a voltage greater than $V_T$ is applied to the cell. In other LCD systems, row access is accomplished via pulse width modulation (PWM) or by applying an analog voltage to charge a capacitor associated with the cell to an intermediate value.

The cells of an LCD are arranged in "rows" and "columns". In this specification and following claims, a row is a horizontal line containing a plurality of cells or pixels. Generally, a plurality of rows are defined from top to bottom on a display. A column is a vertical line containing a plurality of cells or pixels. A plurality of columns are defined from left to right on a display. Each row is assigned a row number, generally increasing from top to bottom, and each column is assigned a column number, increasing from left to right.

To access an individual cell or pixel, the row containing that cell is "strobed" with an "address" pulse. The column containing that cell is also strobed with a "data" pulse. The row address pulse and the column data pulse are individually less than the threshold voltage $V_T$. However, the combination of the two pulses is greater than $V_T$. In this manner, only a cell whose row number and column number is strobed is accessed, and all other cells in the row and column remain in their original state. Alternatively, the rows can be strobed with a data pulse and the columns with an address pulse.

An LCD is known as a "long persistence" display. That is, the display will retain a display image for a long period of time before a refresh cycle is required. By contrast, cathode ray tube (CRT) type displays must be refreshed frequently, or the display image will disappear.

A disadvantage of LCD devices is their relatively slow switching time when a pixel location location is changed from one state to another state. The slow switching time can be distracting to a user. Also, the cumulative effect of slow switching time for each cell location reduces the bandwidth of the display and the ability to display rapidly changing images. This can limit the effectiveness of an LCD in animation applications or other dynamic display contexts.

There have been prior art attempts to provide solutions to these problems by limiting the number of cell locations that are written or updated during a refresh cycle. Harada, et al, U.S. Pat. No. 4,693,563, is directed to a liquid crystal display (LCD) device and a driving method in which only the changing part of the display is refreshed. This is accomplished by refreshing those bands of rows that contain changed elements. A disadvantage of the device of Harada is that unnecessary updates are still required because portions of the bands of rows that contain the changed data are updated even though they do not require updating. In addition, Harada does not disclose a method of updating changes in non-consecutive single rows or columns of an LCD device. This limits the bandwidth of the device of Harada. Additionally, Harada does not disclose a method for identifying changed portions of a display.

Ayliffe, U.S. Pat. No. 4,703,305, describes a drive method for an LCD device that allows display data to be updated a whole row at a time or by a row segment. The device of Ayliffe is directed to the problem that can arise when typing data that is to appear on an LCD, namely the lag time in the data appearing on the display and the unwanted screen flicker that can accompany screen update for this new data. Ayliffe describes a method for defining the columns to the left of a character entry as "unselected columns." Only one column of cells is strobed for update or refresh and this column is sequentially advanced as characters are entered. This update scheme is effective if the key entry is less than 6.25 characters per second. If the entry rate exceeds this level, two characters are updated at one time resulting in a "buffering" effect to the user. Ayliffe does not suggest any method for refreshing non-consecutive columns. In addition, the system of Ayliffe requires a longer duration strobe pulse (at a lower voltage) for segment update than for whole row update. This further reduces the dynamic bandwidth of the display.

Crossland et al. U.S. Pat. No. 4,655,550 is directed to a ferro-electric LCD that allows data to be written to only those cells in each row whose state is to be changed while the remaining cells in the row are refreshed to maintain their existing state. In the embodiment described in Crossland, the existing state of the display is refreshed row by row while new data is written only to every $N^{th}$ row. N is an arbitrarily chosen number and rows to be updated in Crossland are not selected on the basis of whether or not the information they contain is being changed.

Starkey et al. U.S. Pat. No. 4,775,859 describes a drive method for long persistence cathodochromic CRT displays. "Skip words" associated with rows of video data stored in video RAM are used to skip rows that contain no data and for interleaving. In Starkey, lines are skipped because they contain no display data at all or because periodic updating (every second or third row for interleaving) is being implemented. Starkey does not disclose a system for identifying changed locations only for display update.

A number of other prior art patents describe systems for providing improved display output. For example, Ott, U.S. Pat. No. 4,286,320 describes a computing system with a RAM memory sub-system featuring a RAM controller with an automatically incrementing address counter. This auto-incrementing feature eliminates the need for the CPU to generate addresses for reading or writing successive blocks of data, thereby freeing up CPU processing time. Oguchi, U.S. Pat. No. 4,356,482 describes a method of refreshing video data stored in dynamic RAM when (because a magnified image is being displayed) only a portion of the video data is read for display and then rewritten to memory. During a first time period, the portion of the stored video data that represents the magnified images is read, displayed and rewritten to memory. During a subsequent second time period, the remaining video data is refreshed.

Two patents of Dixon, et al. namely, U.S. Pat. Nos. 4,489,378 and 4,490,782 describe memory caching systems in which the data stored in the cache includes data that has already been requested by the CPU as well as additional data that is likely to be requested in the future. Various algorithms are described for determining the makeup of this additional data based on the data actually requested.

Rajaram, U.S. Pat. No. 4,511,965, describes a method for prioritizing CPU and CRT controller access to VRAM. CPU access to VRAM is limited to periods between CRT controller access. Since the CRT controller is given priority access to VRAM, scanning of an image onto the CRT display is not interrupted by CPU access to VRAM. The quality of the image display on the CRT is thereby improved.

Roberts, U.S. Pat. No. 4,796,203, is directed to an interface that allows updated display information to be written simultaneously to a monitor and to a refresh memory. Dawson et al. U.S. Pat. No. 4,884,220, describes an apparatus for directionally scanning a rectangular matrix memory containing image display information to produce perspective and rotated views of the image stored in the matrix.

Sfarti et al. U.S. Pat. No. 4,912,658, describes a graphics controller that stores words from an X by Y array bit map in multiple, identical X by Y array memory chips. (If the bit map consists of 1K by 1K array of 16-bit words, 16 separate one megabit 1K by 1K memory chips are used). Each memory chip in this case stores one bit of each 16-bit word of the bit map in the physical location in the memory chip that corresponds to the logical location of the 16-bit word in the bit map. No translation of the address in the bit map to the physical memory address is required and individual bits can be modified without modifying the entire 16-bit word.

None of the prior art provides a solution to updating individual display elements in non-consecutive rows or columns of a long persistence display or describes systems for increasing the bandwidth of LCD type devices.

SUMMARY OF THE INVENTION

The present invention provides an optimized refresh strategy for increasing bandwidth of an LCD. This results in an LCD suitable for dynamic display of information. In the present invention, a display memory is used to store display data generated by a CPU and to provide that data to an LCD. All data writes to the display memory by the CPU are tracked and rows or columns that contain modified data are tagged. These tags may be "set" by mapping the display memory write addresses to row or column numbers. The tags are examined and mapped back into the display memory addresses and only those rows or columns containing changed data are transferred to the data stream for display. As a result, only the information that is changed in the display memory is sent to the display and the dynamic bandwidth of the display is maximized. The refresh in the present invention can be either row-based or column-based.

In one embodiment, both a fine and a coarse refresh is implemented. In the fine refresh mode, individual rows (or columns) are updated. If a threshold number of rows (or columns) requiring refresh is exceeded, a coarse refresh mode is enabled and regions or bands of rows (or columns) are updated.

DETAILED DESCRIPTION OF THE INVENTION

A method and apparatus for providing improved dynamic bandwidth on an LCD is described. In the following description, numerous specific details, such as number of rows and columns, memory size, etc., are described in detail in order to provide a more thorough description of the present invention. It will be apparent, however, to one skilled in the art, that the present invention may be practiced without these specific details. In other instances, well-known features have not been described in detail so as not to unnecessarily obscure the present invention.

Figure 1:
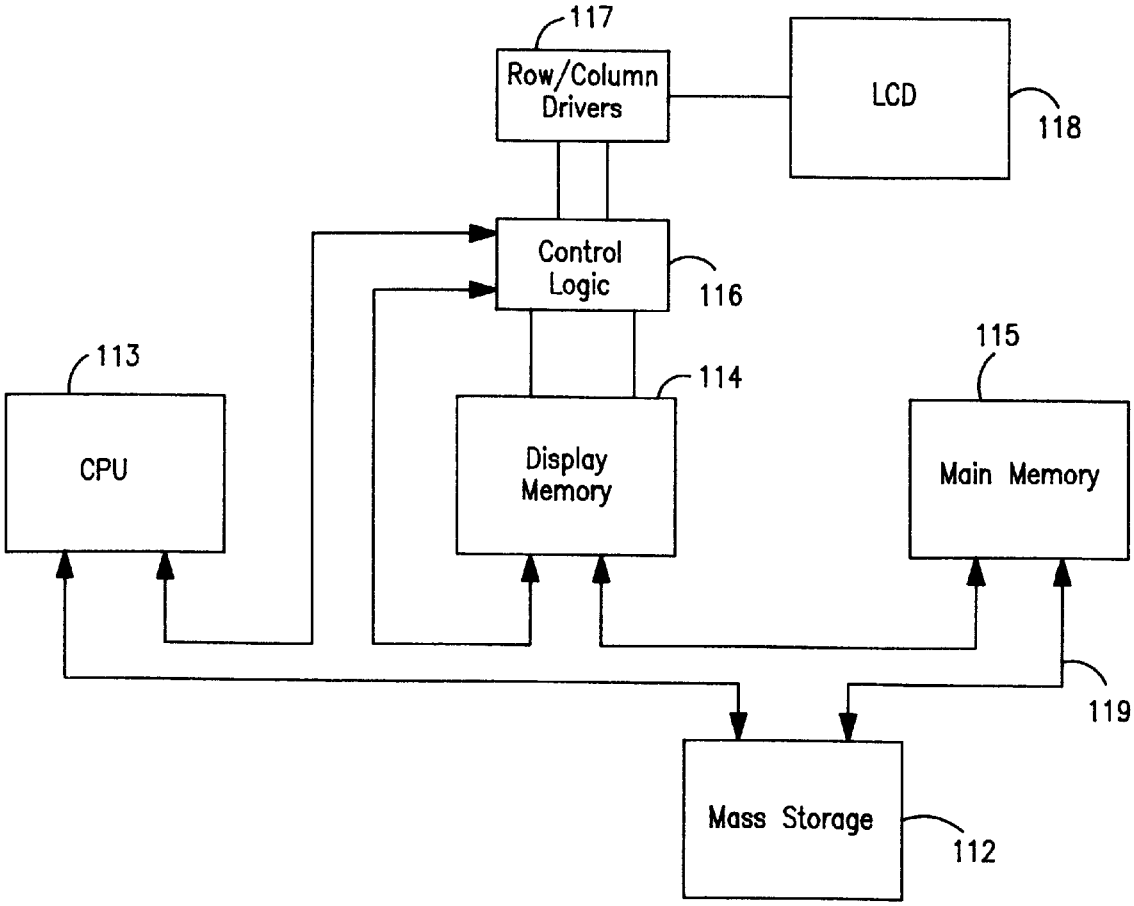
FIG. 1 is a block diagram of a computer system implementing the present invention.

The present invention may be implemented on any conventional or general purpose computer system. An example of one embodiment of a computer system for implementing this invention is illustrated in FIG. 1. The computer system of FIG. 1 also includes a display memory 114, mass storage 112, and main memory 115, all coupled by a bi-directional system bus 119 to CPU 113.

The mass storage 112 may include both fixed and removable media, such as magnetic, optical or magneto-optical storage systems or any other available mass storage technology. The mass storage may be shared on a network, or it may be dedicated mass storage. Bus 119 may contain, for example, 32 address lines for addressing display memory 114 or main memory 115. The system bus 119 also includes, for example, a 32-bit data bus for transferring data between and among the components, such as CPU 113, main memory 115, display memory 114 and mass storage 112. Alternatively, multiplexed data/address lines may be used instead of separate data and address lines.

In the preferred embodiment of this invention, the CPU 113 is a 32-bit microprocessor, such as the 68030 or 68040 manufactured by Motorola. However, any other suitable microprocessor or microcomputer may be utilized. The Motorola microprocessors and their instruction sets, bus structures and control lines are described in the MC68030 users manual and the MC68040 users manual, published by Motorola, Inc. of Phoenix, Arizona.

Main memory 115 is comprised of dynamic random access memory (DRAM) and in the preferred embodiment of this invention, comprises 8 megabytes of memory. More or less memory may be used without departing from the scope of this invention.

The present invention can be practiced with either a VRAM or DRAM display memory 114. As illustrated in FIG. 1, the display memory 114 may be a dual-ported video random access memory (VRAM) consisting of, for example, 256 kbytes of memory. However, more or less display memory may be provided as well. One port of the VRAM display memory 114 is coupled to the system bus 119, and the other port is coupled to control logic and data input block 116, which in turn is coupled to row and column drivers 117. The row and column drivers 117 strobe the necessary cell locations in the LCD device 118 to update changes to the display. LCD 118 is an LCD type of monitor suitable for displaying graphic images, and in the preferred embodiment of this invention has a resolution of 1120 by 832 pixels. Other resolution monitors may be utilized with this invention.

Figure 5:
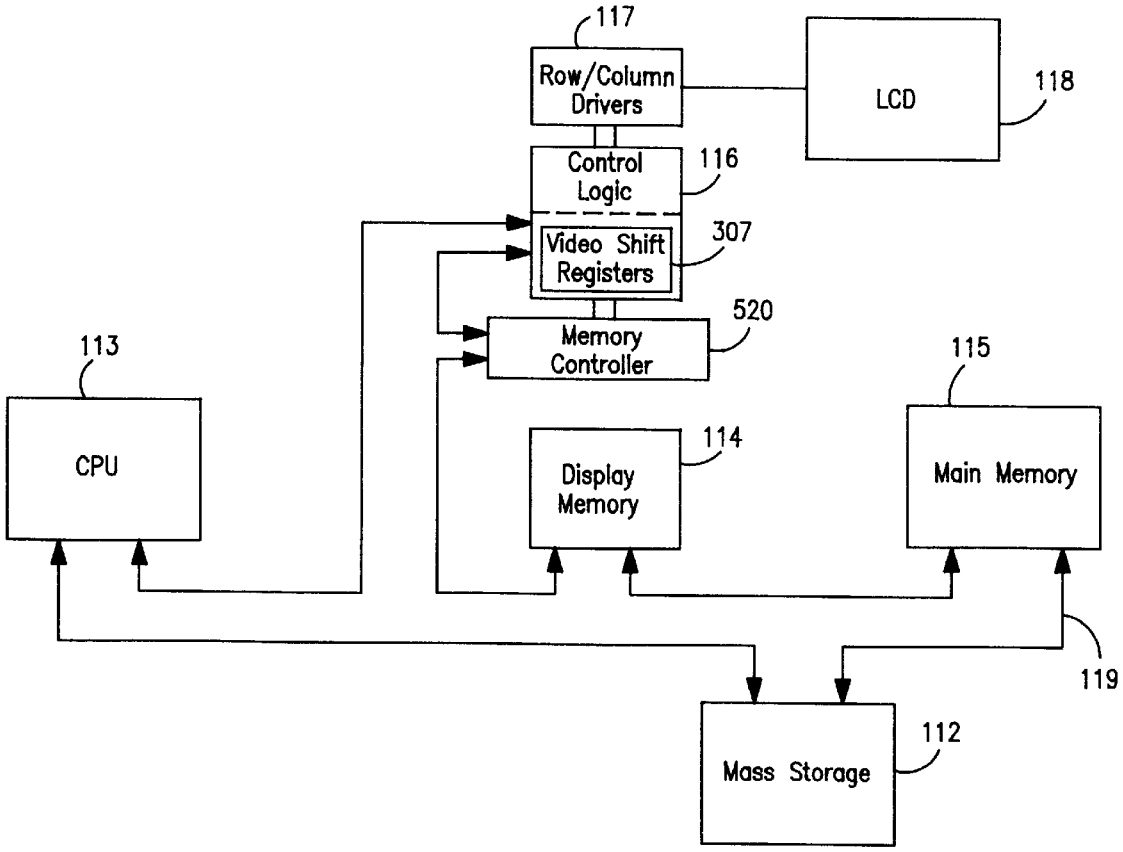
FIG. 5 is a block diagram of an alternate computer system implementing the present invention.

Alternatively, the display memory 114 may be a single-port dynamic random access memory (DRAM) also consisting of 256 kbytes of memory. More or less display memory may be provided as well. FIG. 5 illustrates an embodiment of a computer system that implements the present invention using DRAM display memory. The CPU 113, main memory 115, mass storage 112, bi-directional system bus 119, row/column drivers 117 and LCD 118 are all as in FIG. 1. However, the DRAM display memory's single port is coupled only to the system bus 119 and not directly to the control logic block 116. A memory controller 520 is coupled to the system bus 119 and to the control logic block 116. The control logic block 116 is also coupled to row and column drivers 117 and the system bus 119. The control logic block 116 contains video shift registers 307 that serve as data buffers when the DRAM display memory 114 is in a read cycle. The memory controller 520 monitors the DRAM display memory 114 via the system bus 119 and controls data transfer between the video shift registers 307 and the DRAM display memory 114.

Figure 2:
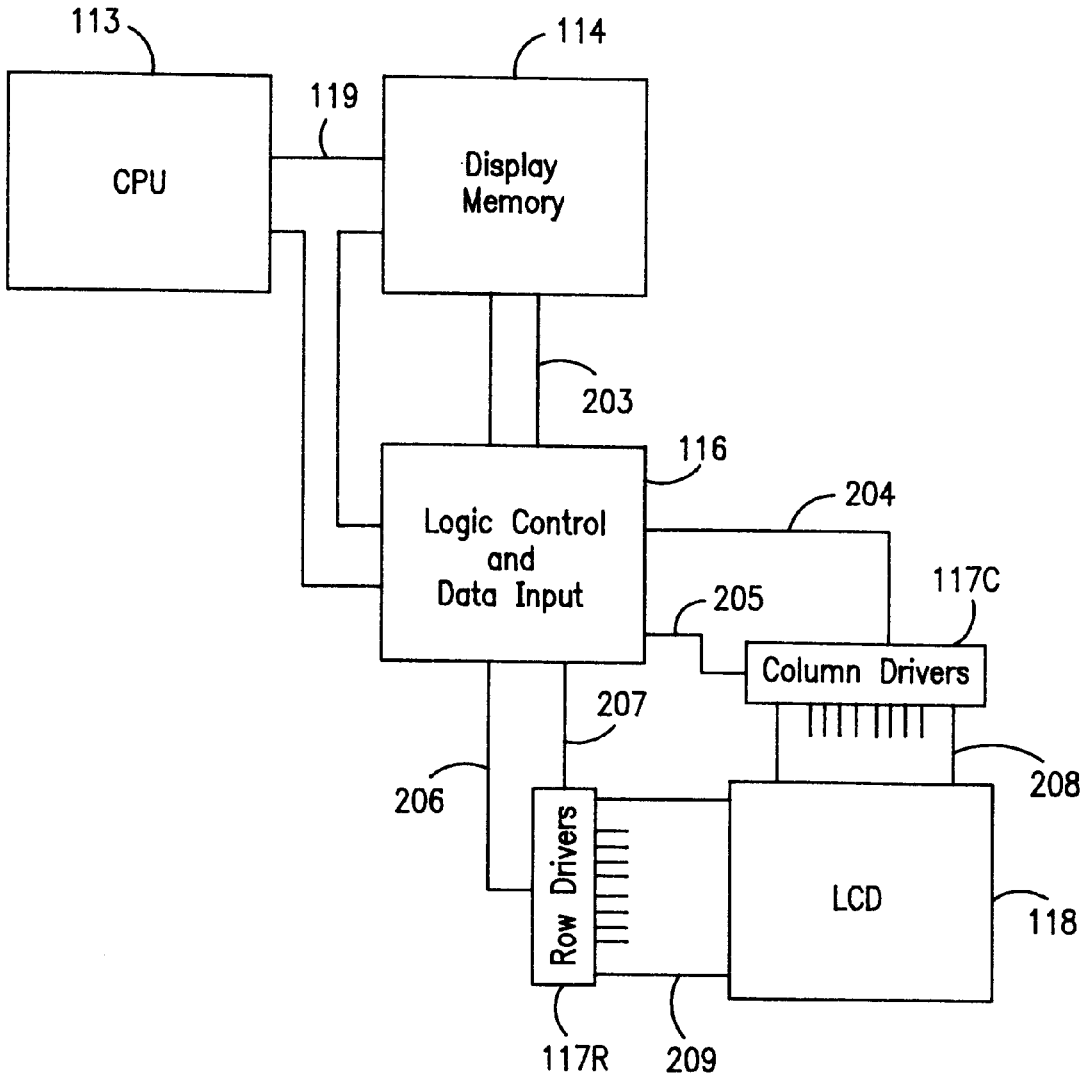
FIG. 2 is a block diagram of an LCD controlled system.

A detailed view of the row and column control of the LCD display 118 is illustrated in FIG. 2. The CPU 113 writes display data to the display memory 114 on bus 119. The display memory 114 provides display data on bus 203 to control logic and data input block 116. Block 116 is also coupled to bus 119 and tracks writes to the display memory 114 by the CPU 113. The control logic block 116 provides column data signal 204 to column drivers block 117C. Data strobe signal 205 is provided by the data input block 116 to the column drivers 117C. The column drivers 117C drive output column lines 208 to selectively strobe selected columns of display 118 with the column data signal 204.

Control block 116 also provides row address signal 206 to row drivers 117R. Data strobe signal 207 is provided by the control logic and data block 116 to row drivers 117R. Row drivers 117R drives selected rows 209 of display 118 with the row address signal 206. The control logic block 116 keeps track of writes to the display memory 114 and tags those rows or columns of the display that contain modified data in the display memory cache. These tags are set by mapping the display memory write addresses to row or column numbers. These tags are examined and the tags are mapped back into the display memory addresses. The corresponding row or column data is then transferred into the data stream of the display. These tags can be examined on either a FIFO (first in, first out) or round-robin basis. As a result, only information that is changed in the display memory is sent to the display, maximizing the dynamic bandwidth of the display.

Alternatively, the address signal could be sent to the column drivers, and the data signal could be sent to the row drivers. In other words, the control logic and data input block 116 could provide column address signal to column drivers 117C, and row data signal to row drivers 117R.

As write accesses are made to the display memory 114 by the CPU 113, changed bits are accumulated for the corresponding row or column of the display. The display controller selects those rows or columns of the display memory data that have changed bits set and sends that data only to the display. After the information has been sent, those changed bits are cleared for the next write cycle.

The display memory 114 is a memory array with one memory address location for each display pixel on the LCD. When a write is made to the display memory by the CPU, address and data are provided on bus 119 from the CPU to the display memory. The control logic block 116 also receives the address and data information on bus 119. The control logic block converts the display memory address to a row and column number and maps this display address into row and column tag storage means. These tags are periodically mapped back to memory addresses and the data at those memory addresses is provided to the display.

Figure 3:
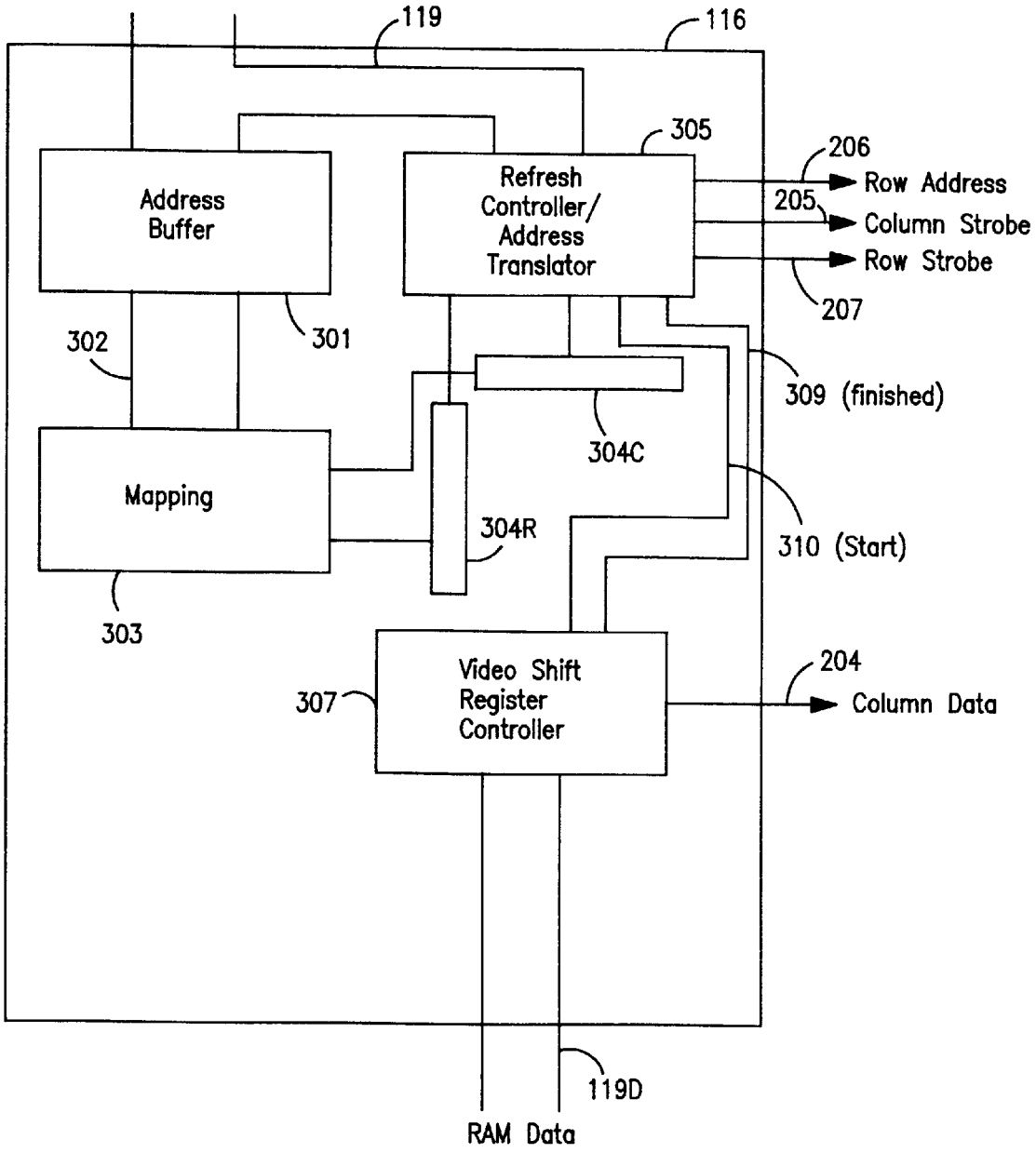
FIG. 3 is a detailed view of the logic block of FIG. 2 for use with VRAM display memory.

The preferred embodiment of the present invention for use with VRAM is illustrated in FIG. 3. An address buffer 301 temporarily stores the address of the display memory locations that are being written to by the CPU. The address buffer 301 provides these addresses to mapping block 303 on bus 302. The mapping block 303 translates the display memory memory address into row and column numbers and sets the appropriate bits in register 304R.

Register 304R is an N bit register where N is equal to the number of rows in the display. A bit corresponding to each row where data is to be written is set to a predetermined value (1 or 0). For example, if the memory address provided to the display memory corresponds to row 5, column 8, the register bit corresponding to row 5 is set in register 304R.

System bus 119 carries both RAM address and data information. Consequently, the system bus 119 can be split into an address bus 119 and a data bus 119D. The logic block 116 contains a refresh controller/address translator 305 (RC/AT) that is connected to the address bus 119. The RC/AT 305 converts the row addresses of the changed bits of the display memory block into the corresponding display row addresses. To access the appropriate data from the display memory, the RC/AT 305 translates the row or column address to the appropriate display memory location.

The logic block 116 contains a video shift register controller 307. RAM data that is being written to the display memory by the CPU is provided by the data bus 119D to the video shift register controller 307.

Periodically, RC/AT 305 provides row address signals 206 to the row drivers 117R, and video shift register controller 307 provides column data signals 204 to column drivers 117C based on the selected memory location. At the same time, RC/AT 305 provides start shift control signal 310 to video shift register controller 307. RC/AT 305 then scans register 304R and provides row signal 207 to the row driver. Only individual rows that have been written to are updated, based on the contents of registers 304R. After each memory cycle, the RC/AT clears register 304R and video shift register controller 307 transmits shift finished control signal 309 to RC/AT 305.

Alternatively, register 304C is used to track which columns have been written to. Register 304C is an M bit register where M is the number of columns in the display. Each bit corresponds to each one of the M columns. As before, RC/AT 305 provides row address signals 206 to the row drivers 117R, and video shift register controller 307 provides column data signals 204 to column drivers 117C based on the selected memory location. At the same time, RC/AT 305 provides start shift control signal 310 to video shift register controller 307. Refresh controller 305 then scans register 304C and provides column strobing signal 205 to the column driver. Only individual columns that have been written to are updated, based on the contents of registers 304C. After each memory cycle, video shift register controller 307 transmits shift finished control signal 309 to RC/AT 305, and the RC/AT clears register 304C.

Alternatively, the RC/AT 305 could convert the address information provided by address bus 119 to column address signals, and video shift register controller 307 could provide row data signals to the row drivers.

Figure 7:
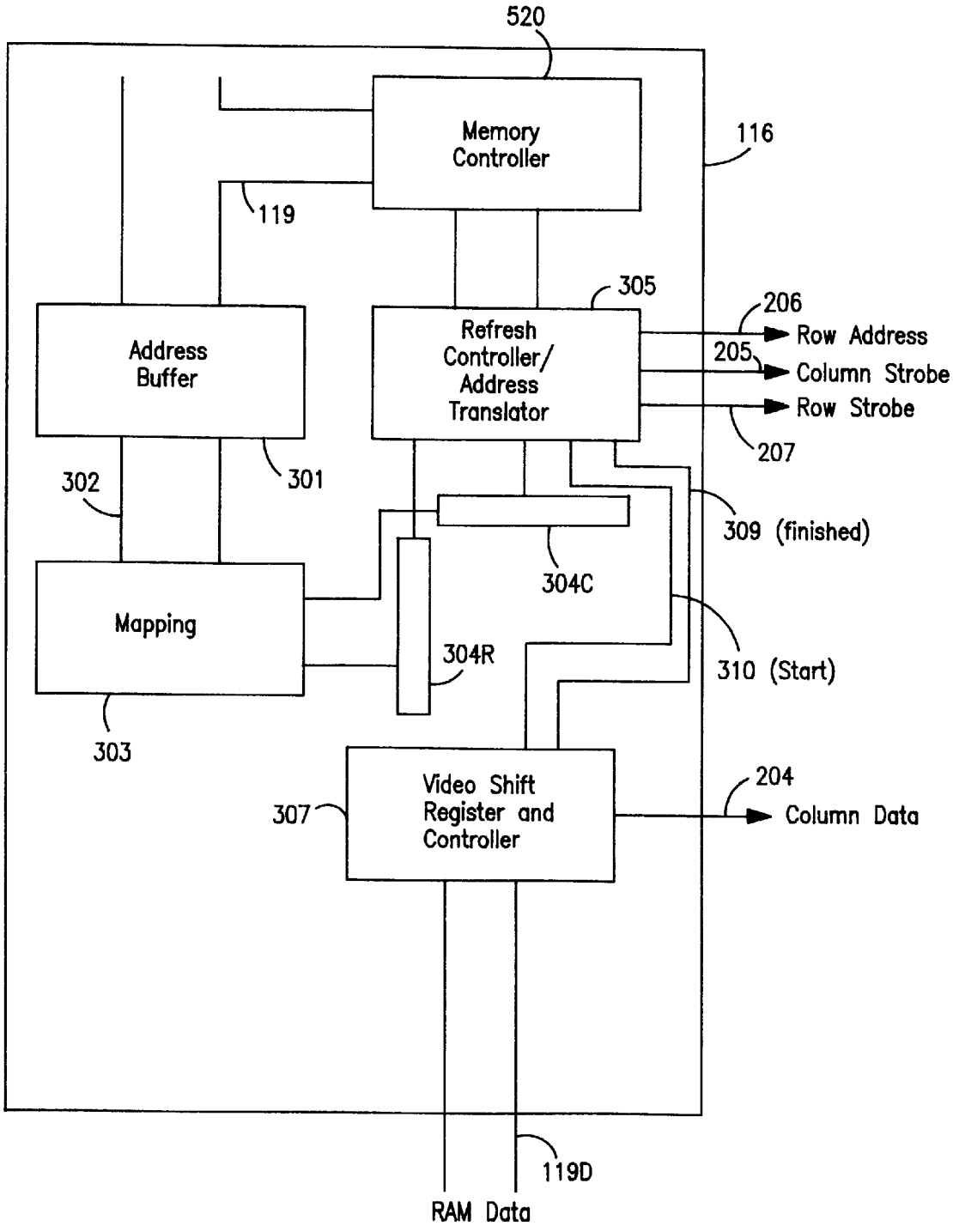
FIG. 7 is an alternate detailed view of the logic block of FIG. 2 for use with DRAM display memory.

Another embodiment of the present invention for use with DRAM is illustrated in FIG. 7. Where the display memory 114 consists of DRAM, the logic block 116 contains video shift registers and controller 307. RAM data that is being written to the display memory by the CPU is provided by the data bus 119D to the video shift registers and controller 307. The video shift registers operate in conjunction with the memory controller 520 to access at the appropriate time the data in the display memory 114.

In another embodiment, the present invention implements a fine/coarse update scheme. A fine update is accomplished for individual rows as described above. The row bit register 304R is monitored and if a threshold number of rows require updating (for example, 25 rows), coarse update is implemented. In coarse update, bands of rows are updated. This fine/coarse update scheme may also be implemented by monitoring the column bit register 304C instead of the row bit register 304R, determining whether a threshold number of columns require updating and, if so, updating bands of columns in the coarse update mode.

Alternatively, the register 304R (or 304C) can be divided into a plurality of registers, each representing a particular screen region. If more than a certain number of rows (or columns) require updating in any one region, such as more than half, the entire region is update in coarse update mode. If less than that number require updating, fine, row by row (or column by column)updating is performed. The size of each of the plurality of registers may represent, for example, one fourth of the rows (or columns) on the display, or any other suitable fraction of the display.

Figure 6:
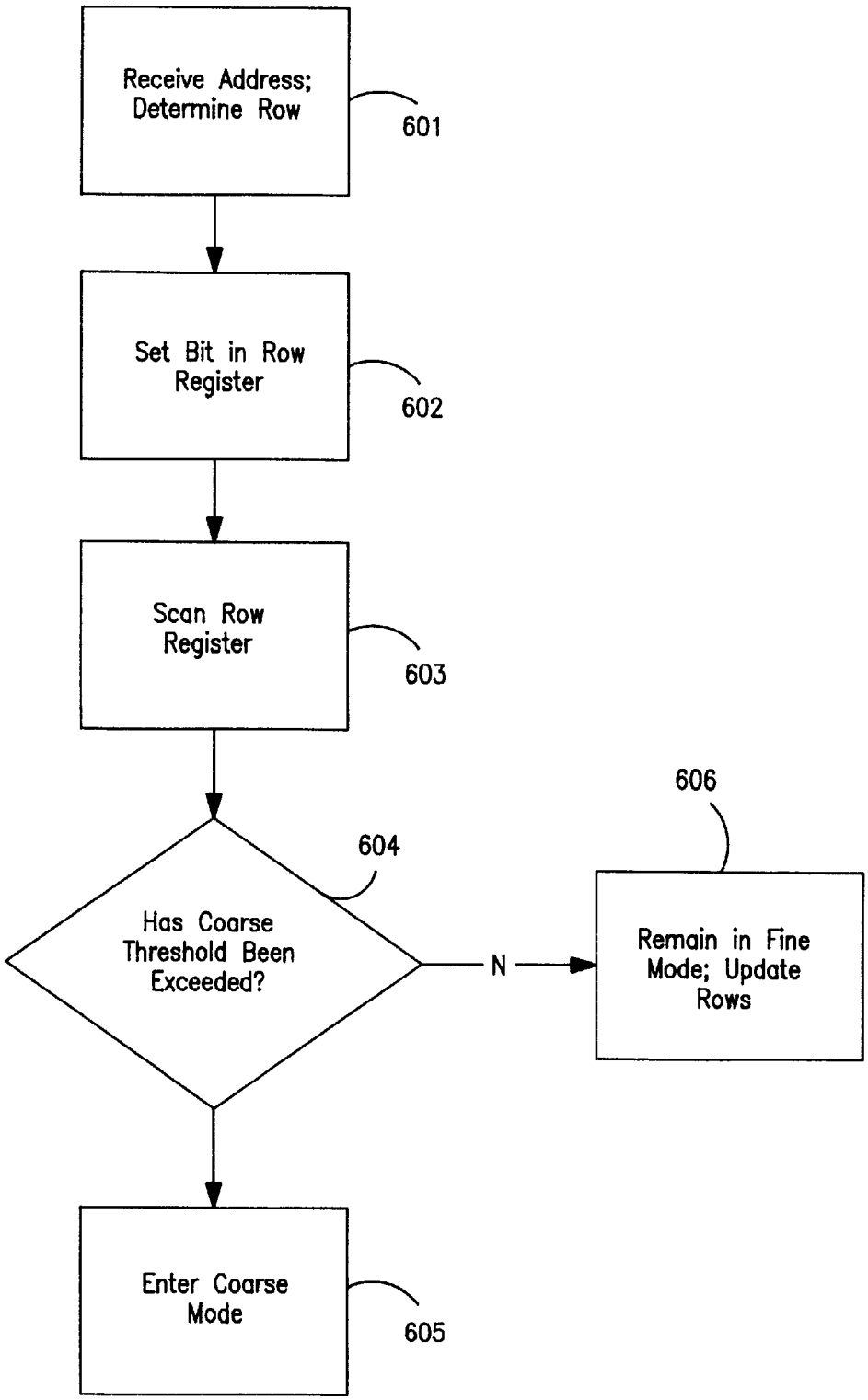
FIG. 6 is a flow diagram illustrating the fine/coarse operation of the present invention.

A flow diagram of the operation of the present invention in fine and coarse mode is illustrated in FIG. 6. For purposes of this description, row updates are monitored. It is apparent, however, to one skilled in the art, that the present invention may be practiced by monitoring column updates instead.

At step 601, an address of a display location to be updated is received and the row containing that address is determined. At step 602, the bit in the row register corresponding to that row is set to indicate that the row requires updating.

Periodically, at step 603, the row register is scanned to determine the number of bits that have been set. At decision block 604, the argument "Has coarse threshold been exceeded?" is made. If the argument is true, the system proceeds to step 605 and the system enters coarse update mode and display updates are done over a screen region or over a band of rows. If the argument at decision block 604 is false, the system remains in fine update mode and proceeds to step 606, where updates are done one row at a time.

Figure 4:
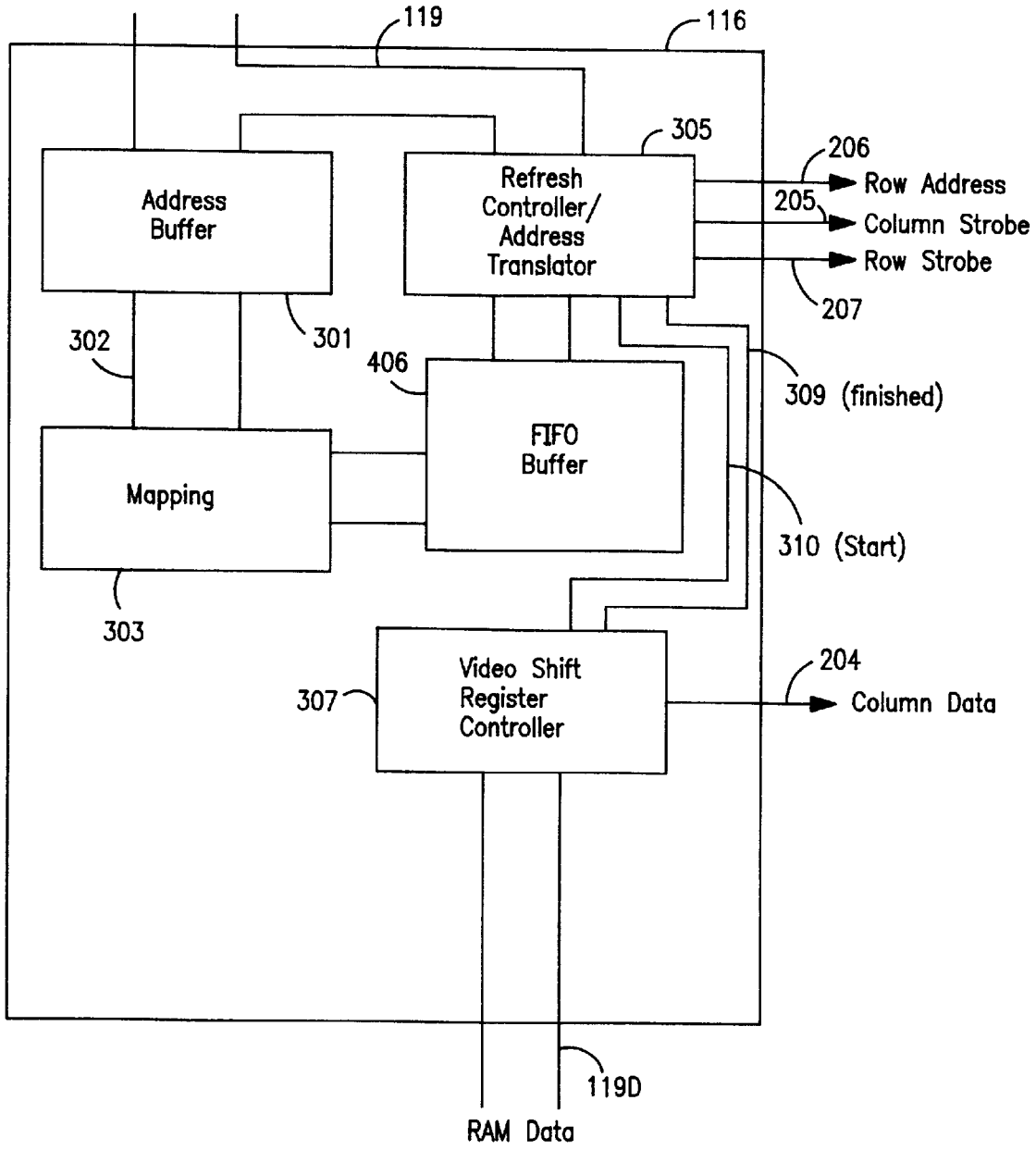
FIG. 4 is an alternate embodiment of the logic block of FIG. 3.

An alternate embodiment of the logic block 116 for use with VRAM is shown in detail in FIG. 4. An address buffer 301 temporarily stores the address of the display memory locations that are being written to by the CPU. The address buffer 301 provides these addresses to mapping block 303 on bus 302. The mapping bus 302 translates the memory address to the row and column numbers corresponding to that memory address. The mapping block 302 then provides the row and column address to FIFO buffer 406.

Periodically (e.g., every memory cycle), RC/AT 305 provides row address signals 206 to the row drivers 117R, and video shift register controller 307 provides column data signals 204 to column drivers 117C based on the selected memory location. At the same time, RC/AT 305 provides start shift control signal 310 to video shift register controller 307. RC/AT 305 then retrieves entries in the FIFO buffer 406 and provides strobe signals 205 and 207 to the row and column drivers 117R and 117C. Only individual rows that have been written to are updated, based on the contents of the FIFO buffer. In this manner, only the display locations that contain changed data are read from the display memory and provided to the display. This permits for a greater bandwidth display because data that does not change is not rewritten to the display. After the changed data is written to the display, video shift register controller 307 transmits finished control signal 309 to RC/AT 305, and the RC/AT 305 clears FIFO buffer 406.

Additionally, the embodiment illustrated in FIG. 4 can be used with DRAM display memory, provided the appropriate changes are made. That is, registers 304R and 304C are replaced with FIFO buffer 406 in FIG. 7.

Thus, a method and apparatus for increasing bandwidth of an LCD is described.

What is claimed is:

1. A display system comprising:

processing means for generating display data and display addresses;

memory means coupled to said processing means for storing said display data at memory addresses corresponding to said display addresses;

logic means coupled to said processing means and said memory means;

row drivers coupled to said logic means and to a display means, said row drivers being for selectively enabling a row of pixels on said display means; and column drivers coupled to said logic means and said display means, said column drivers being for selectively enabling a column of pixels on said display means, said logic means identifying new data that is to be displayed and providing control signals to said row drivers and said column drivers such that those rows and columns containing the new data are enabled during a write cycle, and said logic means being operable to enable contiguous or noncontiguous rows and columns, depending upon the display addresses of the new data to be displayed wherein, if said logic means identifies a number of the display addresses having changed data as changed display locations, then the display addresses having changed data are mapped to corresponding memory addresses of the memory means and the corresponding memory addresses are stored in a storage means, where the memory addresses stored in the storage means are cleared after the changed data at the changed display locations has been written to a display, wherein when the number is less than or equal to a predetermined number, the rows or the columns containing the changed data are separately driven, and when the number is greater than the predetermined number, a plurality of contiguous rows or columns are driven as a region, said region including the rows or the columns containing the changed data.

2. The system of claim 1 wherein said logic means further includes first mapping means for mapping said memory address locations to display addresses and for mapping display addresses to said memory address locations.

3. The system of claim 1 wherein said memory means comprises a dual-ported video random access memory (VRAM).

4. The system of claim 1 wherein said memory means comprises a single-ported dynamic random access memory (DRAM).

5. The system of claim 1 wherein said processing means comprises a microprocessor.

6. The system of claim 1 wherein said row drivers enable selected ones of said rows with a row address signal.

7. The system of claim 1 wherein said column drivers enable selected ones of said columns with a column data signal.

8. The system of claim 1 wherein said column drivers enable selected ones of said columns with a column address signal.

9. The system of claim 1 wherein said row drivers enable selected ones of said rows with a row data signal.

10. The system of claim 1 wherein said display comprises a liquid crystal display (LCD) device.

11. A display system according to claim 1, further comprising:

discrimination means for determining whether or not a number of the display addresses stored by said storage means is larger than a predetermined number, wherein, when said discrimination means determines that the number is less than or equal to the predetermined number, said rows or said columns are driven one-by-one, and when said discrimination means determines that the number is greater than the predetermined number, said rows or columns are not driven one-by-one.

12. A display system comprising:

processing means for generating display data and display addresses;

a video random access memory (VRAM) coupled to said processing means for storing said display data at memory addresses corresponding to said display addresses;

logic means coupled to said processing means and said VRAM;

row drivers coupled to said logic means and to a liquid crystal display (LCD) means, said row drivers being for selectively enabling a row of pixels on said LCD means; and column drivers coupled to said logic means and said LCD means, said column drivers being for selectively enabling a column of pixels on said LCD means, said logic means identifying new data that is to be displayed and providing control signals to said row drivers and said column drivers such that those rows and columns containing the new data are enabled during a write cycle, and said logic means being operable to enable contiguous or noncontiguous rows and columns, depending upon the display addresses of the new data to be displayed, wherein, if said logic means identifies a number of the display addresses having changed data as changed display locations, then the display addresses having changed data are mapped to corresponding memory addresses of the memory and the corresponding memory addresses are stored in a storage means, where the memory addresses stored in the storage means are cleared after the changed data at the changed display locations has been written to an LCD, wherein when the number is less than or equal to a predetermined number, the rows or the columns containing the changed data are separately driven, and when the number is greater than the predetermined number, a plurality of contiguous rows or columns are driven as a region, said region including the rows or the columns containing the changed data.

13. The system of claim 12 wherein said logic means further includes first mapping means for mapping said memory address locations to display addresses and for mapping display addresses to said memory address locations.

14. The system of claim 12 wherein said processing means comprises a microprocessor.

15. The system of claim 12 wherein said row drivers enable selected ones of said rows with a row address signal.

16. The system of claim 12 wherein said column drivers enable selected ones of said columns with a column data signal.

17. The system of claim 12 wherein said column drivers enable selected ones of said columns with a column address signal.

18. The system of claim 12 wherein said row drivers enable selected ones of said rows with a row data signal.

19. A display system according to claim 12, further comprising:

discrimination means for determining whether or not a number of the display addresses stored by said storage means is larger than a predetermined number, wherein, when said discrimination means determines that the number is less than or equal to the predetermined number, said rows or said columns are driven one-by-one, and when said discrimination means determines that the number is greater than the predetermined number, said rows or columns are not driven one-by-one.

20. A display system comprising:

processing means for generating display data and display addresses;

a dynamic random access memory (DRAM) coupled to said processing means for storing said display data at memory addresses corresponding to said display addresses;

logic means coupled to said processing means and said DRAM;

memory controlling means coupled to said logic means and said DRAM;

row drivers coupled to said logic means and to a liquid crystal display (LCD) means, said row drivers being for selectively enabling a row of pixels on said LCD means; and column drivers coupled to said logic means and said LCD means, said column drivers being for selectively enabling a column of pixels on said LCD means, said logic means identifying new data that is to be displayed and providing control signals to said row drivers and said column drivers such that those rows and columns containing the new data are enabled during a write cycle, and said logic means being operable to enable contiguous or noncontiguous rows and columns, depending upon the display addresses of the new data to be displayed, wherein, if said logic means identifies a number of the display addresses having changed data as changed display locations, then the display addresses having changed data are mapped to corresponding memory addresses of the memory and the corresponding memory addresses are stored in a storage means, where the memory addresses stored in the storage means are cleared after the changed data at the changed display locations has been written to an LCD, wherein when the number is less than or equal to a predetermined number, the rows or the columns containing the changed data are separately driven, and when the number is greater than the predetermined number, a plurality of contiguous rows or columns are driven as a region, said region including the rows or the columns containing the changed data.

21. The system of claim 20 wherein said logic means further includes first mapping means for mapping said memory address locations to display addresses and for mapping display addresses to said memory address locations.

22. The system of claim 20 wherein said processing means comprises a microprocessor.

23. The system of claim 20 wherein said row drivers enable selected ones of said rows with a row address signal.

24. The system of claim 20 wherein said column drivers enable selected ones of said columns with a column data signal.

25. The system of claim 20 wherein said column drivers enable selected ones of said columns with a column address signal.

26. The system of claim 20 wherein said row drivers enable selected ones of said rows with a row data signal.

27. A display system according to claim 20, further comprising:

discrimination means for determining whether or not a number of the display addresses stored by said storage means is larger than a predetermined number, wherein, when said discrimination means determines that the number is less than or equal to the predetermined number, said rows or said columns are driven one-by-one, and when said discrimination means determines that the number is greater than the predetermined number, said rows or columns are not driven one-by-one.

* * * * *

UNITED STATES PATENT AND TRADEMARK OFFICE

CERTIFICATE OF CORRECTION

PATENT NO. : 6,078,316

DATED : June 20, 2000

INVENTOR(S) : RICH PAGE ET AL.

It is certified that error appears in the above-identified patent and that said Letters Patent is hereby corrected as shown below:

COLUMN 2

Line 10, "location" (second occurrence) should be deleted;
Line 19, "et al," should read --et al.,--;
Line 54, "et al." should read --et al.,--;
Line 64, "et al." should read --et al.,--.

COLUMN 3

Line 22, "et al," should read --et al.,--;
Line 39, "et al," should read --et al.,--;
Line 43, "et al," should read --et al.,--;
Line 47, "used)." should read --used.)--.

COLUMN 4

Line 10, "is" should read --are--;
Line 37, "is" should read --are--.

COLUMN 5

Line 60, "control block 116" should read --control logic block 116--;
Line 63, "display 118" should read --LCD 118--.

UNITED STATES PATENT AND TRADEMARK OFFICE

CERTIFICATE OF CORRECTION

PATENT NO. : 6,078,316

DATED : June 20, 2000

INVENTOR(S) : RICH PAGE ET AL.

It is certified that error appears in the above-identified patent and that said Letters Patent is hereby corrected as shown below:

COLUMN 6

Line 40, "memory" (first occurrence) should be deleted;
Line 50, "logic block" should read --control logic block--;
Line 58, "logic block 116" should read --control logic block 116--.

COLUMN 7

Line 5, "RC/AT" should read --RC/AT 305--;
Line 23, "RC/AT" should read --RC/AT 305--;
Line 30, "logic block 116" should read --control logic block 116--;
Line 33, "video shift and controller 307." should read --video shift register controller 307.--;
Line 52, "update" should read --updated--;
Line 54, "column)updating" should read --column) updating--.

UNITED STATES PATENT AND TRADEMARK OFFICE

CERTIFICATE OF CORRECTION

PATENT NO. : 6,078,316

DATED : June 20, 2000

INVENTOR(S) : RICH PAGE ET AL.

It is certified that error appears in the above-identified patent and that said Letters Patent is hereby corrected as shown below:

COLUMN 8

Line 15, "mapping bus 302" should read --bus 302--;
Line 17, "mapping block 302" should read --mapping block 303--;
Line 29, "FIFO buffer." should read --FIFO buffer 406.--;
Line 31, "for" should be deleted;
Line 42, "is" should read --are--.

Signed and Sealed this

Twenty-second Day of May, 2001

Attest:

Nicholas P. Godici

NICHOLAS P. GODICI

Attesting Officer

Acting Director of the United States Patent and Trademark Office